United States Patent [19]

Finley

[11] 4,048,889

[45] Sept. 20, 1977

[54] ELASTOMERIC STRIPPER HAVING METAL HEAD AND STRIPPING PLATES

[76] Inventor: George C. Finley, 242 E. Fitzgerald Road, Gerald, Mo. 63037

[21] Appl. No.: 593,277

[22] Filed: July 7, 1975

[51] Int. Cl.[2] ..... B26D 7/08

[52] U.S. Cl. ..... 83/138; 83/139

[58] Field of Search ..... 83/138, 139

[56] References Cited

U.S. PATENT DOCUMENTS

| | | | |
|---|---|---|---|
| 828,225 | 8/1906 | Lorenz | 83/138 X |
| 2,151,119 | 3/1939 | Kiwi | 83/138 |
| 2,732,015 | 1/1956 | Whistler et al. | 83/138 |
| 3,211,035 | 10/1965 | Whistler et al. | 83/139 |
| 3,269,238 | 8/1966 | Whistler et al. | 83/139 |
| 3,670,613 | 6/1972 | Rienzl | 83/139 |
| 3,871,254 | 3/1975 | Whistler et al. | 83/139 |

*Primary Examiner*—J. M. Meister
*Attorney, Agent, or Firm*—Rogers, Eilers & Howell

[57] ABSTRACT

A stripper for use in a sheet punching machine to clear the punch of the punched article is formed of a rectangular prism of resilient elastomeric material having a metal head plate for connection to the punch and a metal stripping plate to clear the punch of the punched article. The head plate and stripper plate have a plurality of projections which are enlarged at the end remote from the plates which engage in cooperating holes in the resilient material. The stripper plate, head plate and elastomeric material can be readily separated to allow convenient exchange and replacement of those parts.

15 Claims, 6 Drawing Figures

ELASTOMERIC STRIPPER HAVING METAL HEAD AND STRIPPING PLATES

BACKGROUND AND SUMMARY OF THE INVENTION

Punches are typically used for perforating sheet stock, such as sheet metals, plastics, leather and similar sheet articles, in processes of forming the sheet stock into various manufactured items. Perforating is accomplished by reciprocating the punches downwardly through the sheet stock over a die opening formed to match the punch. After perforating the punch reciprocates upwardly. After punching the sheet stock tends to stick around the punch and cling to the punch. If the stock clings to the punch the punching operation and the flow of the workpiece through the punch are obstructed.

Typically, punches are provided with a device called a stripper, which clears the punch by forcing the sheet stock away after the punch has reciprocated upwardly after striking and punching the hole. In the past, strippers were made of two parallel plates, concentric about the axis of the punch with the top plate being the head plate and the bottom plate being the stripper plate. A steel spring mechanism was placed between the two plates and held together with shoulder bolts, allowing the distance between the plates to be reduced by the pressure action of the punch and allowing the punch to pass through a hole in the stripper plate to perforate the sheet stock placed below the stripper plate. As the punch reciprocated upward, the spring mechanism forced the stripper plate downwardly, pushing the sheet stock away from the punch. The steel spring mechanism had a number of disadvantages in that it was costly to manufacture, the springs would weaken with age and the travel of the stripper was limited by the spring mechanism itself.

More recently, a stripper mechanism has been used which consists of a circular head plate and a circular stripper plate which are bonded to a cylindrical resilient elastomer material. This bonded mechanism is less costly to manufacture than the previous devices, but it also has a number of disadvantages. One difficulty is that the cylindrical shape of the elastomeric material evidently creates stresses in the material which eventually lead to failure due to fatigue and rupture of the elastomeric material. In addition, the bonded structure requires that the entire stripper mechanism be discarded and replaced with a new one when the elastomer fails. There is no mechanism provided whereby the elastomeric material only can be readily replaced. Further, the elastomer device and the steel spring devices require that a large variety of strippers must be kept in inventory, since each stripper will operate effectively for only one predetermined punch diameter.

I have devised a new stripper mechanism which eliminates the defects in prior devices by utilizing a resilient elastomeric material as the spring. The elastomeric material is formed in a prism of rectangular or square cross section. This shape appears to eliminate or reduce the cast in stresses in the elastomeric material with the result that the material has a much longer life and does not fail as readily due to rupture from fatigue. In addition, by using a rectangular or square cross section, more of the elastomeric material may be used in a given space on the punch apparatus so that greater endurance is acheived. By being able to introduce a larger volume of elastomeric material into the stripper, less compression force per unit volume is required to clear the punch of the sheet stock. As a result the elastomeric material is fatigued less.

In addition, I have provided a structure which allows the head plate, stripper plate or the elastomeric spring to be readily interchanged. As a result, considerable savings are achieved since, on failure of the elastomeric material, a new elastomeric part can be readily substituted without replacing the entire stripper mechanism.

Considerable savings are also achieved in required inventory. One elastomeric spring is adaptable for use in stripper mechanisms which will cooperate with a number of punches of varying diameters. It is not necessary to carry as great a spare parts inventory of different sizes of strippers in order to have the flexibility required in a varied punching operation or shop. Therefore, less capital is tied up in inventory and less space is required in storing parts.

DESCRIPTION OF THE PREFERRED EMBODIMENT

Figures 1, 2, 3, 4, 5, 6:
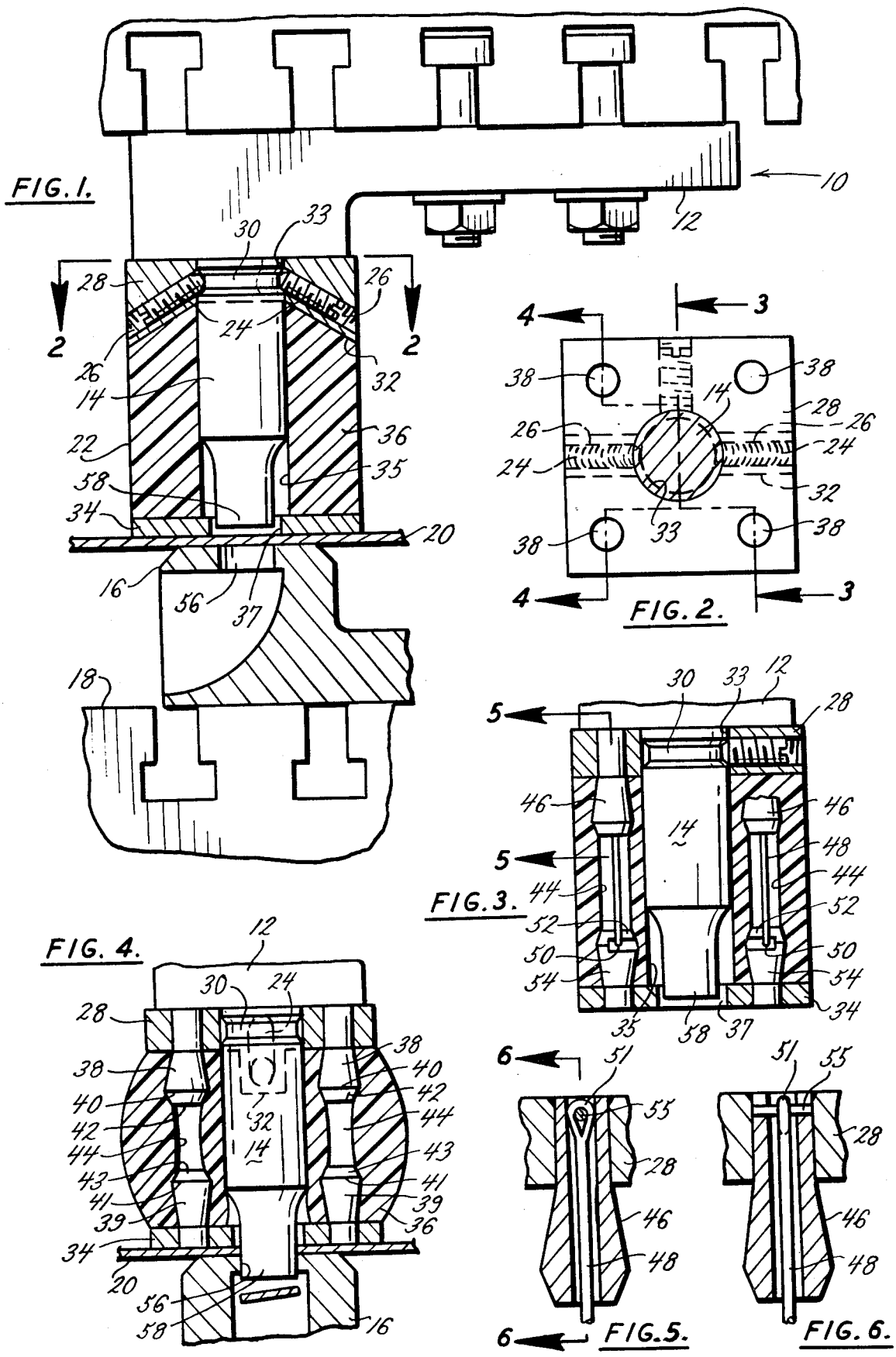
FIG. 1 is a side plan view of a punching mechanism showing a punch holder, punching die, workpiece and a stripper of the invention.
FIG. 2 is a top plan view of the stripper of the invention.
FIG. 3 is a cross sectional view of the stripper taken along the plane of line 3—3 in FIG. 2.
FIG. 4 is a cross sectional view of a modification of the stripper shown as taken along the plane of line 4—4 of FIG. 2.
FIGS. 5 and 6 are views of details of the modified structure of FIG. 4.

Referring in more detail to the drawings, a stamping machine 10, shown in FIG. 1, is equipped with a punch holder 12 having a punch 14, a die 16, and a die holder 18. A work piece 20, such as a piece of sheet steel, passes between punch 14 and die 16. A stripper 22, according to the invention, is attached to punch 14 by set screws 24 which pass through holes 26 in head plate 28 and engage groove 30 in punch 14. The head plate 28 has depending ears 32 which allow the set screws 24 to be set in groove 30 at an angle from below the plane of groove 30.

Stripper 22 has a stripper plate 34 and joined between head plate 28 and stripper plate 34 is resilient elastomeric spring 36. Elastomeric spring 36 can be made of neoprene, rubber, or other similar elastomers, but the preferred material for its manufacture is a commercial polyurethane material having a flexure index of about 35% to failure. We have found that this material has enough resistance to have a strong resisting force when compressed so that when pressure is removed from the punch, it pushes strongly against the workpiece to clear the punch. This type of material is well known in the industry and is used in a variety of machining applications. Typical material could be obtained from Wencol, Inc., St. Louis, Mis., under the trademark Weneolane.

As shown, the head plate 28 and stripper plate 34 are square and the urethane or elastomeric spring 36 is formed of a square prism of a cross section equal to that of the head plate 28 and stripper plate 34. The resilient elastomeric material 36, the head plate 28 and the stripper plate 28 have communicating central holes 33, 35 and 37 through which punch 14 is received and through which the head plate 28 is fastened to the punch 14 received therein, as previously described. The resilient elastomeric spring 36 and the stripper plate 34 are not directly attached to the punch 14 and are free to move relative thereto. The hole 37 in the stripper plate 34 is selected to be slightly larger than the diameter of punch 14 to be received therethrough so as not to bind on the punch 14 during operation, but the stripper plate 34 should be spaced closely enough to the punch 14 so as to be effective to clear tne workpiece 20 away from the punch 14 when the punch 14 is retracted, as is known in the art.

As shown in FIG. 4, the head plate 28 and stripper plate 34 each have four outwardly extending lugs 38 and 39 extending outwardly therefrom and attached by a conventional means such as welding. The terminal end of lugs 38 and 39 have enlarged portions 40 and 41. Enlarged portions 40 and 41 have terminal portions 42 and 43 of reduced diameter to facilitate entry into the elastomeric material as subsequently described. Resilient elastomeric spring 36 has four cylindrical holes 44 extending longitudinally through the spring 36 and adapted to receive the enlarged ends 40 of lugs 38, 39 to retain the spring 36 on head plate 28 and to retain stripping plate 34 on spring 36.

As shown in FIGS. 3, 5 and 6, head plate 28 may be equipped with lugs 46 which have attached thereto the flexible cables 48 which at the lower end have loops 50 and similar lops 51 at the upper ends. Loops 50 can be engaged with hooks 52 in lower lugs 54 attached to stripping plate 34 as a further means of retaining the head plate 28, resilient spring 36 and stripping plate 34 in an assembled relationship. The upper loop 51 of cables 48 are retained in lugs 46 by pins 55.

As shown in FIG. 4, the stripper functions as a spring. When punch holder 12 is forced downwardly by punching machine 10, punch 14 is forced through the opening 56 in die 16 and punching interposed sheet 20. Considerable compressive force is transferred to resilient elastomeric spring 36 as a result of the compression between workpiece 20 and stripping plate 34 on one side of spring 36 and the head plate 28 on the other side of spring 36, resulting in compressive forces building up in the elastomeric spring 36. When the stamping machine 10 raises punch holder 12 and punch 14 at the completion of the punching cycle, to the position shown in FIG. 1, the compressive forces built up in the elastomeric spring 36 force stripping plate 34 downwardly against the workpiece 20 to clear the workpiece 20 from the punch end 58.

This punching and stripping action can be repeated through many cycles due to the durability of the elastomeric material from which spring 36 is made. The cross sectional area of the head plate and the resilient elastomeric spring 36 is considerably greater than that of a stripper having a circular cross section of the diameter equal to the side of the cross section of spring 36. The spring 36 then has a greater volume of elastomeric material than a comparable stripper of circular cross section. The greater volume increases the life of the elastomer material considerably since the stress per unit volume can be reduced and still achieve the same total compressive force in elastomeric spring 36. It has been found that the fatigue rate decreases as the compressive stress applied per unit volume is decreased. A typical material might have a maximum compression of about 35% of its volume before ultimate rupture. If this maximum rate is applied repeatedly, failure is much quicker than if the material is stressed at one half of that ultimate rate. The endurance of the material can be increased considerably by stressing it at the lower rate.

The stripping action, or the force with which the stripper will clear the workpiece from the punch end, is a function of the total force applied to the elastomeric material. Therefore, by increasing the volume of the elastomeric material and maintaining a constant total stress, the same stripping force can be achieved at a lower stress per unit volume of the elastomeric material. In addition, I believe that by using a rectangular or square cross section, I am able to relieve the built in stresses which are in the elastomeric spring due to its cylindrical shape so that the fatigue factor inherent in the shape of the material is thereby reduced, thus increasing the life of the elastomeric spring.

In addition, when failure of the elastomeric spring ultimately occurs in my device, it is possible to quickly replace the elastomeric spring with a new one, thereby avoiding the expense of replacing the entire stripping unit. To replace the elastomeric spring, all that is required is to insert a small lever, such as a screw driver, between the elastomeric spring 36 and the head plate 28 and separate the spring 36 and head plate 28 with a prying action. The stripper plate 34 can be similarly separated from spring 36. A replacement element 36 can then be forced up over the enlarged ends 40, 41 of lugs 38, 39 with the cylindrical holes 44 engaging around lugs 38, 39. The cylindrical holes 44 are of uniform cross section and of a diameter smaller than the enlarged portions 40, 41 of lugs 38, 39, and due to the resiliency of the elastomeric material, will allow the lugs 38, 39 to be forced into the holes 44 and will hold tightly to the lugs 38, 39 to prevent the stripper assembly from inadvertently becoming disconnected.

In the configuration shown in FIG. 3, it is necessary to separate the stripper plate 34 and spring 36 by inserting a small lever and prying the lugs apart while also applying a twisting action to the lugs so that loops 50 of cables 48 will disengage from hooks 52 of lugs 54. When the stripper plate 34 has been removed, the resilient element 36 can be removed from head plate 28 as previously described. To replace a resilient element 36 using the configuration shown in FIG. 3, it is necessary to insert lugs 46 with cables 48 through the cylindrical openings 44 and then attach stripper plate 34 using lugs 54 having hooks 52 by a twisting action, so that hooks 52 will engage and be retained in loops 50 of cables 48.

By using the replaceable configuration of the invention, it is possible to use an identical elastomeric spring 36 with stripper plates and head plates adapted to a variety of punch diameters so that it is not necessary to retain in stock a separate complete stripper configuration for each punch diameter used. It is only necessary to have a separated stripper plate and head plate to match the punch diameter. This enables a considerable savings to be achieved in inventory of spare parts, particularly since duplication of purpose can be achieved with a single spring unit.

It will be apparent to those skilled in the art that many changes and modifications may be achieved in the invention shown without departing from the scope of the appended claims. While the preferred embodiments are shown herein for the purposes of illustration, it is intended that the invention is to be limited only by the scope of the claims attached hereto.

I claim:

1. A stripper for use in a mechanical punching operation comprising means to attach the stripper to a punch, means to contact a workpiece during punching, and means to resiliently exert a force on the contacting means during punching, the resilient means being interposed between the attaching means and the contacting means, the resilient means having an axially extending cavity therein, the attaching means and contacting means having perpendicular projections cooperating with the cavity to removably connect the stripper into an assembly, the cooperating means being selectively engageable and disengageable to allow the assembly to be selectively assembled and disassembled.

2. The stripper of claim 1 wherein the resilient means has means forming a hole longitudinally through the resilient means for receiving a punch therein.

3. The stripper of claim 1 wherein the projection has an enlarged portion at a point on the projection spaced from the attaching means.

4. The stripper of claim 1 wherein the projections have enlarged portions at a point on the projections spaced from the attaching means and contacting means.

5. The stripper of claim 1 wherein the attaching means has means to receive a punch therethrough and means through the attaching means for selectively engaging a punch.

6. The stripper of claim 5 wherein the attaching means is a plate and wherein the plate has means through the plate at an angle to the plane of the plate for selectively engaging a punch.

7. The stripper of claim 1 wherein the resilient means has a cavity therein and the contacting means has a projection cooperating with the cavity to connect the stripper into an assembly, the cooperating means being selectively engageable and disengagable to allow the assembly to be selectively assembled and disassembled.

8. A stripper for use in a mechanical punching operation comprising a head plate having means defining a hole through the plate in a direction perpendicular to the plate, the head plate having a first projection from a surface of the plate, the first projection having means defining an opening through the first projection and the plate at an angle to the plane of the plate, the opening being threaded to receive a set screw to attach the head plate to a punch, the head plate having a second perpendicular projection from a surface of the plate, the projection having an enlarged portion at its extremity remote from the plate, the stripper having a stripper plate, the stripper plate having means defining a hole through the plate in a direction perpendicular to the plate, the stripper plate having perpendicular projection from the surface of the plate, the projection having an enlarged portion at its extremity remote from the plate, the stripper having a resilient elastomeric spring, the spring having means defining a hole therethrough, the hole being centrally positioned in the spring, the spring having axially extending means adapted to receive the head plate second projection with the enlarged portion of the projection firmly held thereby and adapted to receive the stripper plate projection with the enlarged portion of the projection firmly held thereby, the stripper, when assembled with the spring interposed between the head plate and stripper plate, having the hole in the head plate, the hole in the spring, and the hole in the stripper plate communicating and cooperating to receive a punch through the assembly for reciprocally stripping a work piece off of the punch, the stripper being capable of being selectively assembled and disassembled by engaging and disengaging the cooperating projections and receiving means.

9. The stripper of claim 8, wherein a flexible cable is removably connected between the head plate and stripper plate to partially restrain movement of the plates.

10. In a resilient spring for use in a stripper for a mechanical punching operation having means to attach the stripper to a punch, means to contact a workpiece during punching and resilient spring means to resiliently exert a force on the contacting means during punching the improvement comprising an elastomeric prism resilient spring means having a centrally located hole therethrough forming a longitudinal extending passage through the elastomeric prism for receiving a punch therein, the elastomeric prism having means forming a plurality of second holes extending longitudinally therethrough, the second holes being spaced from the longitudinally extending passage and being spaced inwardly from the periphery of the prism, the second holes cooperating with a plurality of projections extending from the attaching means and contacting means of a stripper to join the prism to the attaching means and contacting means of the stripper and permitting selective assembly and disassembly of the stripper when included therein.

11. A stripper for use in a mechanical punching operation comprising means to attach the stripper to a punch, means to contact a workpiece during punching and means to resiliently exert a force on the contacting means during punching, the resilient means being interposed between the attaching means and the contacting means and having an axially extending cavity therein, the attaching means and contacting means each having at least one projection extending perpendicular to the contacting means and attaching means and each projection being spaced from the periphery of the contacting means and the attaching means, the projections having means to selectively connect and remove the resilient means from the stripper assembly including enlarged portions at a point on the projections spaced from the attaching means and the contacting means.

12. A stripper for use in a mechanical punching operation comprising means to attach the stripper to a punch, means to contact a workpiece during punching, and means to resiliently exert a force on the contacting means during punching, the resilient means being interposed between the attaching means and the contacting means, and means to selectively connect and remove the resilient means from the stripper assembly and wherein the assembly has additional means to partially restrain movement of the contacting means including a flexible cable removably connected between and cooperating with the attaching means and contacting means.

13. The stripper of claim 12 wherein the attaching means and the contacting means have substantially planar surfaces and the projections thereon extend substantially perpendicular to the planar surfaces, the projections being spaced inwardly from the periphery of the attaching means and the contacting means.

14. A stripper for use in a mechanical punching operation comprising means to connect the stripper to a punch, means to contact a workpiece during punching and means to resiliently exert a force on the contacting means during punching, the resilient means being interposed between the attaching means and the contacting means, the resilient means being an elastomeric prism having a first means forming a first hole longitudinally therethrough to receive a punch therein, the resilient means having a second means forming a second longitudinal hole therethrough, the second longitudinal hole being spaced inwardly from the periphery of the prism, the attaching means and the contacting means having projections thereon, the projections having means cooperating with the second longitudinal hole and permitting selective assembly and disassembly of the stripper.

15. A stripper for use in a mechanical punching operation comprising means to attach the stripper to a punch, means to contact a workpiece during punching and means to resiliently exert a force on the contacting means during punching, the resilient means being interposed between the attaching means and the contacting means and wherein the attaching means the contacting means are plates having substantially planar portions and the resilient means is an elastomeric prism, the attaching means, contacting means and resilient means each having means forming a centrally located hole therethrough, the holes being located to cooperate and form a longitudinal extending passage through the stripper assembly for receiving a punch therein, the resilient means having means formaing a plurality of second holes extending longitudinally therethrough, the second holes being spaced from the longitudinally extending passage and being spaced inwardly from the periphery of the prism, the attaching means and the contacting means having a plurality of projections extending substantially perpendicular to the planar portions thereof and having means to cooperate with the second holes and resilient means to permit selective assembly and disassembly of the stripper.

* * * * *